US007000441B2

(12) United States Patent
Sutton et al.

(10) Patent No.: US 7,000,441 B2
(45) Date of Patent: Feb. 21, 2006

(54) LOCK CYLINDER ASSEMBLY

(75) Inventors: Patrick Richard Sutton, Pembrokeshire (GB); Geoffrey Neil Goldsmith, Pembrokeshire (GB)

(73) Assignee: Henry Squire & Sons Limited, (GB)

( * ) Notice: Subject to any disclaimer, the term of this patent is extended or adjusted under 35 U.S.C. 154(b) by 0 days.

(21) Appl. No.: 10/347,158

(22) Filed: Jan. 17, 2003

(65) Prior Publication Data

US 2003/0136162 A1 Jul. 24, 2003

(30) Foreign Application Priority Data

Jan. 18, 2002 (GB) ..... 0201110

(51) Int. Cl.
*E05B 47/06* (2006.01)

(52) U.S. Cl. ..... 70/276; 70/278.3; 70/278.7

(58) Field of Classification Search ..... 70/276, 70/278.7, 278.2, 278.3, 277, 283, 283.1, 70/279.1

See application file for complete search history.

(56) References Cited

U.S. PATENT DOCUMENTS

| | | | | |
|---|---|---|---|---|
| 4,603,564 A | | 8/1986 | Kleinhäny et al. | |
| 4,807,454 A | * | 2/1989 | Sengupta et al. | 70/277 |
| 4,848,115 A | * | 7/1989 | Clarkson et al. | 70/276 |
| 5,010,750 A | * | 4/1991 | Boser et al. | 70/276 |
| 5,140,317 A | * | 8/1992 | Hyatt et al. | 340/5.25 |
| 5,552,777 A | | 9/1996 | Gokcebay et al. | 340/825.31 |
| 5,791,177 A | * | 8/1998 | Bianco | 70/283.1 |
| 5,839,307 A | * | 11/1998 | Field et al. | 70/283 |
| 6,125,673 A | | 10/2000 | Luker | 70/276 |
| 6,155,089 A | * | 12/2000 | Hurskainen et al. | 70/278.3 |
| 6,474,122 B1 | * | 11/2002 | Davis | 70/278.3 |
| 6,891,458 B1 | * | 5/2005 | Hyatt, Jr. et al. | 335/267 |

FOREIGN PATENT DOCUMENTS

| | | |
|---|---|---|
| DE | 298 06 098 | 8/1998 |
| EP | 0 526 904 | 2/1993 |
| EP | 0 943 763 | 9/1999 |
| EP | 1 134 335 | 9/2001 |
| GB | 2 071 197 A | 9/1981 |

* cited by examiner

*Primary Examiner*—Lloyd A. Gall
(74) *Attorney, Agent, or Firm*—Andrus, Sceales, Starke & Sawall, LLP

(57) ABSTRACT

The present invention relates to a lock cylinder assembly (10) comprising a cylinder housing (12); a cylinder (14); a first electromagnetic coil (48); a first locking member (52); and a key. The cylinder (14) is rotatable in the cylinder housing (12) and the first locking member (52) is urged by a first magnetic field towards a locked position in which rotation of the cylinder (14) is prevented. In use, when the first electromagnetic coil (48) is energised upon the use of the key, a second magnetic field created thereby causes the at least one locking member (52) to move out of the locked position so as to allow said cylinder (14) to be rotated in the cylinder housing (12).

17 Claims, 2 Drawing Sheets

LOCK CYLINDER ASSEMBLY

FIELD OF THE INVENTION

The invention relates to an electronic lock cylinder assembly.

BACKGROUND OF THE INVENTION

Electronic locks have a number of advantages over normal mechanical locks. They may be encrypted so that only a key carrying the correct code will operate the lock, and they may also contain normal mechanical tumblers. They may contain a microprocessor so that, for example, a record can be kept of who has operated the lock in a certain time period, or so that they are only operable at certain times. They may also have the advantage that, if a key is lost the lock may be reprogrammed to prevent the risk of a security breach, or to avoid the expense of replacement.

Locks utilising some type of electronic element are known.

U.S. Pat. No. 5,542,274 discloses a lock having a key-operated, rotatable cylinder. A latching element is located in the region of the boundary surface between the cylinder housing and the cylinder and is resiliently urged by springs into a groove in the cylinder. An electrically actuable blocking element is moveable between a release position in which the latching element can be moved out of the recess when the cylinder is rotated, and a blocking position. The cylinder cannot be turned by means of the key when the blocking element is in its blocking position because the blocking element prevents the latching element from being moved out of the groove in the cylinder.

U.S. Pat. No. 5,552,777 discloses a mechanical lock and key including an electronic access control feature for preventing opening of the lock, even with the correct mechanical key unless prescribed conditions are met. A cylinder rotatable in a cylinder housing is fitted with an "ID chip" and a switch connected to a solenoid capable of withdrawing a blocking pin when energised. The blocking pin is resiliently urged by a spring into a bore in the cylinder housing when the cylinder is in the locked position. When a key, containing a battery, microprocessor and database, is inserted into the lock an electrical connection is made to the ID chip, if the serial number of the ID chip matches one of the numbers held in the database, the key is authorised to open the lock. The switch is activated and the solenoid energised withdrawing the blocking pin against the action of the spring enabling mechanical opening of the lock.

WO 01/55539 discloses an electronic locking system having a cylinder housing in which a cylinder is rotatable, and having a lock member moveable between a locked position and an open position under the influence of a solenoid. In the locked position, the lock member prevents a spring loaded locking pin in the cylinder from being moved out of engagement with a cavity in the cylinder housing and so interferes with the rotary movement of the cylinder. The solenoid is energised when a key containing a power source and generating the correct signal is inserted into the lock, so moving the locking member into its open position and allowing the cylinder to be rotated.

All of the above locks suffer from the disadvantages that they are relatively complex and cumbersome and that they require mechanical springs to return the locking element to its locked position once the current has been removed. This leads to an increase in the space required within the lock for the locking members, and can also lead to a reduced life span of the lock caused by mechanical failure of the springs.

The lock cylinder assembly of the present invention seeks to obviate or mitigate the above disadvantages by providing a locking member that can be moved both into and out of its locked position without the need for any mechanical springs or other mechanical biasing means.

SUMMARY OF THE INVENTION

According to a first aspect of the present invention, there is provided a lock cylinder assembly comprising:

i. a cylinder housing;
ii. a cylinder rotatable in said cylinder housing;
iii. at least one electromagnetic coil;
iv. at least one locking member which is urged by a first magnetic field towards a locked position in which rotation of the cylinder is prevented; and
v. a key;

wherein, in use, when said at least one electromagnetic coil is energised upon the use of the key, a second magnetic field created thereby causes said at least one locking member to move out of said locked position so as to allow said cylinder to be rotated in said cylinder housing.

Preferably, said at least one electromagnetic coil is located entirely within said cylinder.

Preferably, said at least one locking member is moveable into and out of said locked position in a direction parallel to the axis of rotation of said cylinder. However, it is within the scope of the present invention for the said at least one locking member to be moveable into and out of said locked position in a direction perpendicular to the axis of rotation of said cylinder, or at any angle to said axis of rotation of said cylinder between parallel and perpendicular.

Preferably, the or each locking member is or includes a permanent magnet providing said first magnetic field.

Preferably, the or each electromagnetic coil comprises a coil with a soft magnetic core. The arrangement is preferably such that, when said electromagnetic coil is de-energised, said first magnetic field causes the locking member to be attracted to said soft magnetic core and thereby biased toward said locked position, and when said electromagnetic coil is energised, said locking member is repelled from said soft magnetic core away from the locked position so as to allow said cylinder to rotate in said cylinder housing.

In a preferred embodiment of the lock cylinder according to the present invention, said lock cylinder possesses a pair of locking members.

Preferably, the locking members are arranged to be moved in opposite directions under the influence of the magnetic field applied by said at least one electromagnetic coil in use.

Preferably, said current to energise said electromagnetic coil is provided by an external source. More preferably said external source is provided in the key.

Further embodiments of the present invention are envisaged in which; said at least one locking member is positioned between said electromagnetic coil and a further magnetic coil, and the further electromagnetic coil, when energised provides said first magnetic field to urge said locking member towards its locked position.

A further embodiment in which said at least one electromagnetic coil has a hard magnetic core is also envisaged. In this embodiment, said at least one locking member is or includes a permanent magnet which is arranged with respect to the hard magnetic core such that, when the electromagnetic coil is de-energised, said locking member is attracted toward the core and into its locking position. When a current of sufficient magnitude is passed through said electromagnetic coil, the polarity of said hard magnetic core is reversed causing said at least one locking member to be moved away from its locking position. In an alternative embodiment of this, the, each or at least one of the locking members is arranged so that it is repelled by the hard magnetic core into its locking position when the coil is de-energised, and so that it is attracted towards the core and out of its locking position when the coil is energised.

A further embodiment of the present invention in which said at least one locking member is or includes a soft magnetic material, and in which said electromagnetic coil includes a soft magnetic core, is contemplated. In this embodiment, a permanent magnet having a magnetic field strength of less than the electromagnetic coil when energised, is provided for the or each locking member. This is positioned on the opposite side of the soft magnetic locking member to the electromagnetic coil. In use, when said electromagnetic coil is de-energised, said locking member is attracted to said permanent magnet and held in a locked position so that said cylinder cannot be turned in said cylinder housing. When the electromagnetic coil is energised, the locking member is urged away from its locked position.

According to a second aspect of the present invention, there is provided a lock having a lock cylinder assembly according to the first aspect of the present invention connected to a latching means, wherein said lock cylinder acts to prevent or allow said latching means to be operated dependant upon whether said at least one locking member of said lock cylinder is or is not in its locked position.

BRIEF DESCRIPTION OF THE DRAWINGS

An embodiment of the present invention will now be described in more detail by way of example only, with reference to the accompanying drawings, in which.

DETAILED DESCRIPTION OF THE PREFERRED EMBODIMENTS

Figure 1:
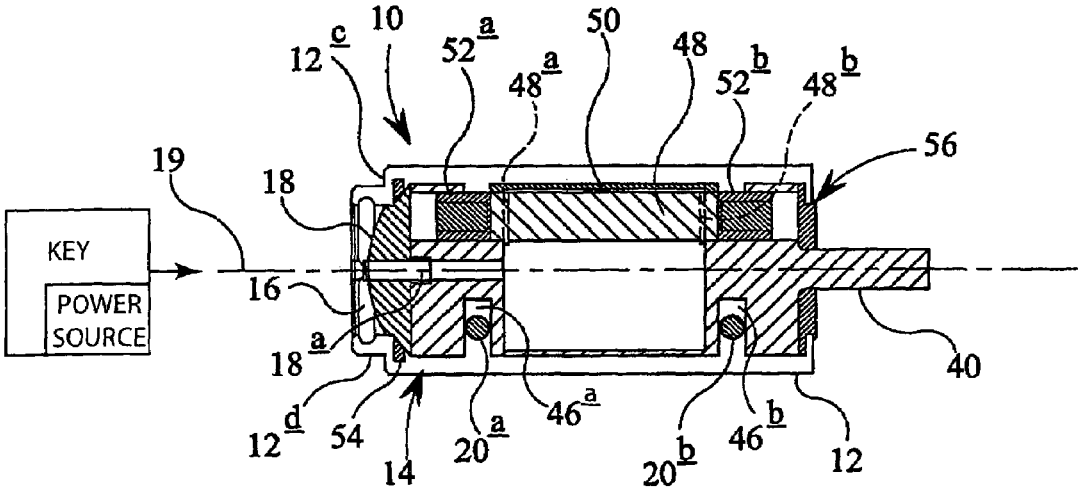
FIG. 1 is a longitudinal cross section of a lock cylinder assembly according to the present invention.

Referring now to FIG. 1, in this embodiment the lock cylinder assembly 10 comprises a cylindrical cylinder housing 12 of a non magnetic zinc alloy, a cylinder 14 also of a non magnetic material mounted in the cylinder housing 12, and a key socket 16 formed by a key contact plate 18 and part of the cylinder housing 12.

Figure 2:
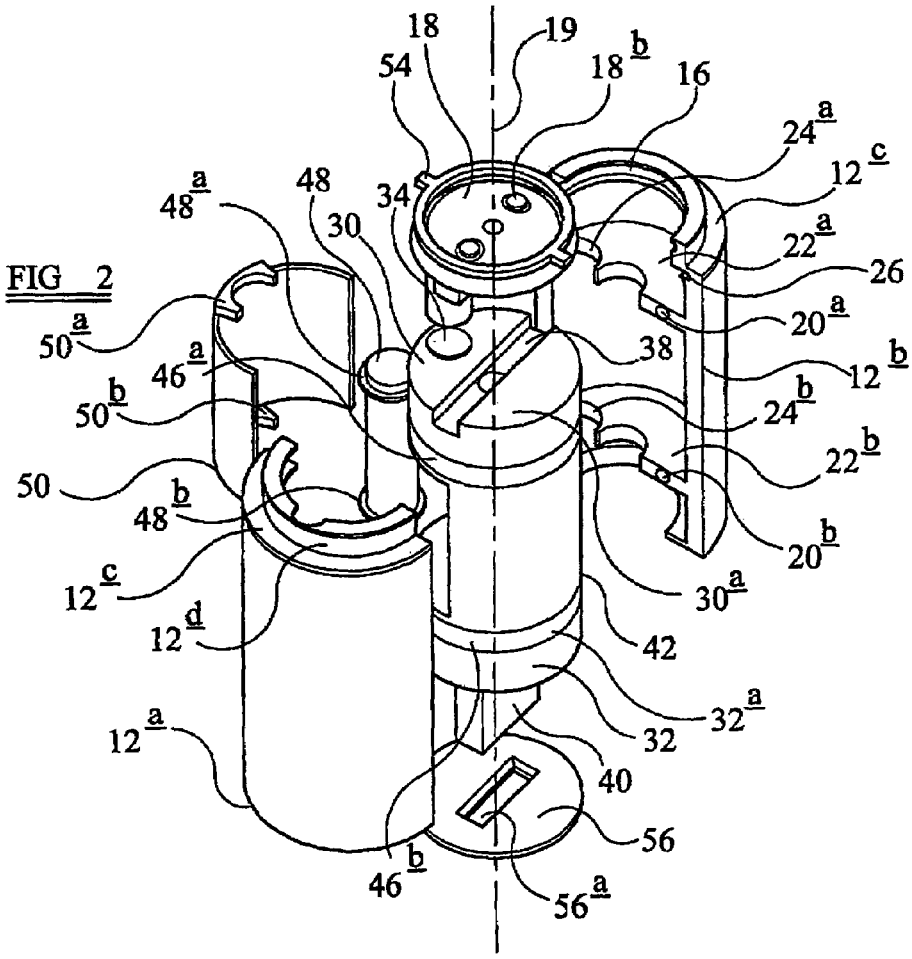
FIG. 2 is an exploded view of the lock cylinder assembly of FIG. 1.
Figure 3:
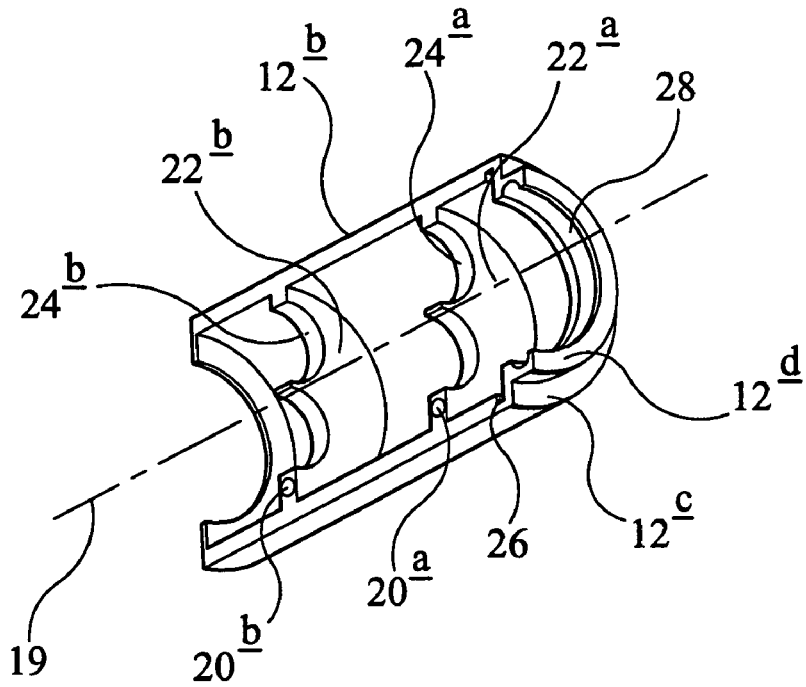
FIG. 3 is perspective view of one half of the cylinder housing of the lock cylinder assembly of FIG. 1.

Referring now to FIGS. 2 and 3, the cylinder housing 12 is formed by two half shells 12*a*, 12*b*. The shells are held together by connectors comprising pins on the first half shell 12*a* (not shown) which are formed to be aligned and co-operable with holes 20*a*, 20*b* formed in the second half shell 12*b*. The formed cylinder housing 12 has a collar 12*c* and a reduced diameter region 12*d* at one end which forms part of the key socket 16. The cylindrical cylinder housing 12 has a longitudinal central axis 19. The formed cylinder housing 12 further defines a pair of longitudinally axially spaced internal annular walls 22*a*, 22*b* positioned towards opposite ends of the cylinder housing. The annular walls 22*a*, 22*b* have circular openings 24*a*, 24*b* therein. The openings 24*a*, 24*b* are aligned with one another along a second longitudinal axis radially displaced from the longitudinal axis 19 of the cylinder housing 12. The cylinder housing 12 further has a first annular groove 26 positioned adjacent the collar 12*c* and a second annular groove 28 within the key socket region 16.

Figure 4:
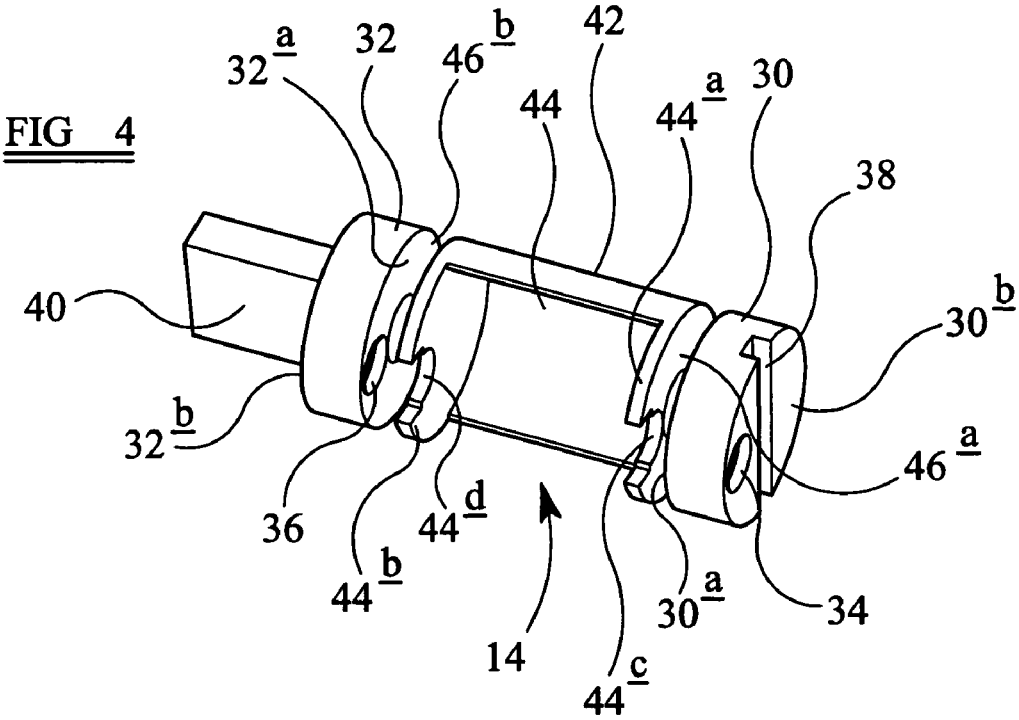
FIG. 4 is a perspective view of the cylinder of the lock cylinder assembly of FIG. 1.

Referring now to FIG. 4, the cylinder 14 has first and second disc-like end regions 30, 32, having axially inner 30*a*, 32*a* and outer 30*b*, 32*b* surfaces, which are spaced apart along a first cylinder longitudinal axis which, when the cylinder 14 is mounted in the cylinder housing 12, is coincident with the longitudinal axis 19 of the cylinder housing 12. The first and second end regions 30, 32 have first and second bores 34, 36 respectively therethrough which are coaxially disposed on a second cylinder longitudinal axis radially displaced from the first cylinder longitudinal axis. The second cylinder longitudinal axis is displaced such that the bores 34, 36 are in alignment with the circular openings 24*a* 24*b* in the internal annular walls 22*a*, 22*b* of the cylinder housing 12 when the cylinder 14 is mounted therein. The first end region 30 further has a channel 38 extending across the diameter of the outer surface 30*b*. The second end region 32 is further integrally formed with a latch operating member 40 extending from its outer surface 32*b*. The cylinder 14 further comprises a central region-42 which is cut away so as to define a chamber 44. The chamber 44 has end walls 44*a*, 44*b*-provided with openings 44*c*, 44*d* which are aligned with the bores 34, 36 in the first and second end regions 30, 32 respectively. The end walls 44*a*, 44*b* of the chamber and the inner surfaces 30*a*, 32*a* of the first and second end regions 30, 32 together define a pair of annular grooves 46*a*, 46*b* around the cylinder 14.

Referring now to FIGS. 1 and 2, an electromagnetic coil 48 (only shown schematically), in the form of a winding around a soft iron core, having a length equal to that of the central region 42 of the cylinder 14, and the same diameter as the bores 34, 36 in the end regions 30, 32, is seated in the openings 44*c*, 44*d* in the walls 44*a*, 44*b* of the chamber 44 so as to align with the bores 34, 36 in the first and second end regions. The electromagnetic coil 48 is prevented from being longitudinally displaced by a pair of collars 48*a*, 48*b* which abut against the walls 44*a*, 44*b* of the chamber 44, and is held in place by a cylinder cover 50. The cylinder cover 50 has regions 50*a*, 50*b* which co-operate with the openings 44*c*, 44*d* in the walls 44*a*, 44*b* of the chamber 44 so as to lock the electromagnetic coil 48 in place. Space is also provided in the chamber 44 for the circuitry (not shown) required to operate the lock cylinder assembly 10. This circuitry can provide the lock with a unique code or set of codes so that only insertion of a key carrying the correct validation code will result in activation of the lock.

First and second locking members are provided in the form of magnetic shuttles 52*a*, 52*b* having a hardened outer coating surrounding a hard magnetic core. The first magnetic shuttle 52*a* is positioned in the bore 34 in the first cylinder end region 30, and the second magnetic shuttle 52*b* is positioned in the bore 36 in the second cylinder end region 32. The shuttles 52*a*, 52*b* are of a diameter so as to form a close sliding fit with the bores 34, 36, and of a length equal to the length of the end regions 30, 32 of the cylinder 14.

The key contact plate 18 is made of tungsten carbide and has the same diameter as the cylinder 14. The key contact plate 18 has a rib 18*a* on its rear surface to engage with the channel 38 in the outer surface 30*b* of the first end region 30, and three electrical connections on its front surface 18*b* which can be electrically connected via the circuitry in the chamber 44 to the electromagnetic coil 48 allowing the coil to be energised.

In the assembled lock cylinder 10, the inner annular walls 22*a*, 22*b* of the cylinder housing 12 co-operate with the corresponding annular grooves 46*a*, 46*b* in the cylinder 14, and act to hold the cylinder 14 within the cylinder housing 12. The openings 24*a*, 24*b* in the inner walls 22*a*, 22*b* of the cylinder housing 12 are of the same dimensions as the bores 34, 36 in the cylinder 14 with which they can be aligned. The key contact plate 18 abuts the outer surface 30*b* of the first end region 30 of the cylinder 14 when the rib 18*a* is seated in the channel 38. The key contact plate 18 is held in position by the collar 12*c* on the cylinder housing 12. A seal 54 is positioned on the key contact plate and held in place in the first groove 26 in the cylinder housing 12 to prevent dirt and moisture ingress into the lock cylinder assembly 10. The key contact plate 18 acts to retain the first magnetic shuttle 52*a* in the first end region 30 of the cylinder 14. The second magnetic shuttle 52*b* is retained in the second end region 32 of the cylinder 14 by an annular inner end plate 56 rotatable relative to the cylinder housing 12. The inner end plate 56 has an opening 56*a* therein through which the latch operating member 40 extends and acts to prevent tampering and entry of dirt as well as acting as a support for the member 40 and retaining the second magnetic shuttle 52*b*.

The key socket 16 allows a key (not shown) containing a power supply to engage with the key contact plate 18 so as to energise the electromagnetic coil 48 if the key is correctly coded. The second groove 28 acts in conjunction with a mechanical retention means on the key, to retain the key in place in the key socket 16 allowing it to be turned. Rotation of the key results in rotation of the key contact plate 18 and the cylinder 14 to operate the lock.

In use, a lock containing the lock cylinder-assembly 10 maintains a locked position until the electromagnetic coil 48 is energised by insertion of the correct key. FIG. 1 shows the lock cylinder assembly 10 in its locked position in which the first and second bores 34, 36 in the cylinder end regions 30, 32 are aligned with the openings 24*a*, 24*b* in the internal walls 22*a*, 22*b* of the cylinder housing 12. The first and second magnetic shuttles 52*a*, 52*b* are attracted by their own magnetic fields to the soft iron core of the de-energised electromagnetic coil 48 and take up positions such that they extend from the end regions 30, 32 and across the annular grooves 46*a*, 46*b*. In this position the first and second magnetic shuttles 52*a*, 52*b* extend into the openings 24*a*, 24*b* in the internal walls 22*a*, 22*b* of the cylinder housing 12. This results in the cylinder 14 being locked against rotation relative to the cylinder housing 12 by the first and second magnetic shuttles 52*a*, 52*b* which, when a rotational force is applied, engage the internal walls 22*a*, 22*b* of the cylinder housing 12 and the end regions 30, 32 of the cylinder 14.

Upon insertion of a key into the key socket 16 an electrical connection is made between the key and the electrical contacts 18*b* on the key contact plate 18. This results in a signal being passed to the circuitry in the chamber 44. If the signal is validated by the circuitry, current from the key is passed to the electromagnetic coil 48 which is then briefly energised. Energising the electromagnetic coil results in the generation of a magnetic field of a strength and direction to cause the magnetic shuttles 52*a*, 52*b* to be repulsed so that they no longer extend into the annular grooves 46*a*, 46*b* in the cylinder 14 and are situated fully within the end regions 30, 32 of the cylinder 14. The obstruction to relative rotation of the cylinder 14 within the cylinder housing 12 is removed and the cylinder 14 is then freely rotatable within the cylinder housing 12 by rotation of the-key, the key being releasably held in the key socket 16 by a mechanical key retention means (not shown) such as a spring loaded ball detent. Rotation of the cylinder 14 rotates the integrally formed latch-operating member 40 and opens the lock. The electromagnetic coil 48 remains energised only for sufficient time for the cylinder 14 to be rotated away from its locked position, and will not be re-energised until the key is removed and reinserted. Upon rotation of the cylinder 14 the bores 34, 36 in the end regions 30, 32 in which the shuttle members 52*a*, 52*b* are positioned become misaligned with the openings 24*a*, 24*b* in the internal walls 22*a*, 22*b* of the cylinder housing 12. In this position, when the electromagnetic coil 48 is de-energised the magnetic shuttles 52*a*, 52*b* cannot return to their locked position under the influence of their magnetic fields. Upon closure of the lock, the bores 34, 36 in the cylinder end regions 30, 32 and the openings 24*a*, 24*b* in the internal walls of the cylinder housing 12 become realigned. The magnetic shuttles 52*a*, 52*b* re-enter the annular grooves 46*a*, 46*b* through the openings 24*a*, 24*b* under the influence of their magnetic fields and lock the cylinder 14 against rotation within the cylinder housing 12.

What is claimed is:

1. A lock cylinder assembly comprising:

a cylinder housing;

a cylinder rotatable in said cylinder housing;

a first electromagnetic coil and a key;

a pair of spaced apart locking members movable along an axis parallel to a rotational axis of the cylinder, each locking member being urged by a first magnetic field towards a locked position in which rotation of the cylinder is prevented by engagement between the locking members and the cylinder housing;

wherein, in use, when the first electromagnetic coil is energized upon the use of the key, a second magnetic field created thereby causes the locking members to move out of said locked position so as to allow said cylinder to be rotated in said cylinder housing.

2. A lock cylinder assembly according to claim 1, wherein the first electromagnetic coil is located entirely within said cylinder.

3. A lock cylinder assembly according to claim 1, wherein at least one of the locking members is or includes a permanent magnet providing said first magnetic field.

4. A lock cylinder assembly according to claim 1, wherein the first electromagnetic coil comprises a coil with a soft magnetic core.

5. A lock cylinder assembly according to claim 4, wherein the arrangement is such that, when the first electromagnetic coil is de-energized, said first magnetic field causes the locking members to be attracted to said soft magnetic core and thereby biased toward said locked position, and when the first electromagnetic coil is energized, said locking members are repelled from said soft magnetic core away from the locked position so as to allow said cylinder to rotate in said cylinder housing.

6. A lock cylinder assembly according to claim 1, wherein the first electromagnetic coil has a hard magnetic core.

7. A lock cylinder assembly according to claim 6, wherein at least one locking member is or includes a permanent magnet arranged with respect to the hard magnetic core such that, when the first electromagnetic coil is de-energised, said locking member is in its locking position.

8. A lock cylinder assembly according to claim 1, wherein at least one locking member is or includes a soft magnetic material, and in which the first electromagnetic coil includes a soft magnetic core.

9. A lock cylinder assembly according to claim 1, wherein the locking members are arranged to be moved in opposite directions under the influence of the magnetic field applied by the first electromagnetic coil in use.

10. A lock cylinder assembly according to claim 1, wherein current to energize the first electromagnetic coil is provided by an external source.

11. A lock cylinder assembly according claim 10, wherein said external source is provided in the key.

12. A lock having a lock cylinder assembly according to claim 1 connected to a latching means, wherein said lock cylinder acts to prevent or allow said latching means to be operated dependant upon whether said locking members of said lock cylinder are or are not in their locked position.

13. A lock cylinder assembly as claimed in claim 1, wherein the cylinder has a pair of axially spaced apart annular grooves therein, and in said locked position of the locking members they protrude into said annular grooves respectively to prevent said rotation of the cylinder.

14. A lock cylinder assembly as claimed in claim 13, wherein said cylinder housing defines a pair of axially spaced apart internal walls, said internal walls being axially aligned with and projecting into said annular grooves respectively, so that with the locking members in said locked position, rotation of the cylinder is prevented by engagement of the locking members in said grooves respectively with said respective internal walls.

15. A lock cylinder assembly as claimed in claim 14, wherein there are respective openings in said internal walls into which the locking members extend in said locked position.

16. A lock cylinder assembly as claimed in claim 13, wherein the cylinder has a central region from which respective end regions are spaced by the annular grooves, said end regions having respective bores therein fully to receive said locking members, in an unlocked position when said first electromagnetic coil is energized upon said use of the key.

17. A lock cylinder assembly as claimed in claim 16, wherein the first electromagnetic coil is located entirely within said central region of the cylinder.

* * * * *